United States Patent [19]

Baum

[11] Patent Number: 4,545,414

[45] Date of Patent: Oct. 8, 1985

[54] BELT-SUPPORTED CAMERA BAG

[76] Inventor: Frank M. Baum, 1030 E. 30th St., Hialeah, Fla. 33013

[21] Appl. No.: 581,805

[22] Filed: Feb. 21, 1984

[51] Int. Cl.[4] ..... A45C 3/10

[52] U.S. Cl. ..... 150/52 J; 150/107; 150/113; 190/115; 224/224; 224/908

[58] Field of Search ..... 150/52 J, 106, 107, 150/113; 224/151, 224, 908; 383/14; 190/115, 116

[56] References Cited

U.S. PATENT DOCUMENTS

| | | | |
|---|---|---|---|
| 3,316,951 | 5/1967 | Jacobson | 224/151 |
| 3,722,377 | 3/1973 | Hayes | 383/14 |
| 3,910,470 | 10/1975 | Swenson et al. | 224/908 |
| 4,037,633 | 7/1977 | Gordon | 383/14 |
| 4,210,186 | 7/1980 | Belenson | 150/52 J |
| 4,260,004 | 4/1981 | Domke | 150/52 J |
| 4,286,697 | 9/1981 | Baker | 224/224 |
| 4,287,971 | 9/1981 | Doulet | 224/224 |
| 4,403,638 | 9/1983 | Baum | 150/52 J |
| 4,442,960 | 4/1984 | Vetter | 383/14 |
| 4,463,789 | 8/1984 | Leiserson | 150/52 J |

FOREIGN PATENT DOCUMENTS

| | | | |
|---|---|---|---|
| 2838289 | 9/1979 | Fed. Rep. of Germany | 150/52 J |

*Primary Examiner*—Joseph Man-Fu Moy
*Assistant Examiner*—David Fidei
*Attorney, Agent, or Firm*—Ernest H. Schmidt

[57] ABSTRACT

A cushioned camera bag for field use by photographers has shoulder and waist support straps, usable individually or both together, for secure support of the bag, while at the same time providing for free use of the hands in using the camera equipment. One side of the camera bag is provided with a separate compartment, defined by a zippered cover flap, within which the waist strap or belt is contained and hidden when not in use.

4 Claims, 6 Drawing Figures

BELT-SUPPORTED CAMERA BAG

This invention relates to cushioned equipment bags or field bags of the type used by photographers for the support and carrying of camera equipment including, for example, cameras and camera accessories, such as camera lenses, filters and film. Such camera bags are usually carried with use of hand straps, or shoulder straps allowing freedom of the hands while making use of the equipment. Such hand or shoulder carried camera bags are difficult to manage when the photographer user is very active, such as when running through crowds to cover important sports or news events. With the hands occupied with a camera, for example, the camera bag is apt to swing around in a manner that not only makes it difficult to run, but also may be injurious to any delicate camera accessories being carried in the bag.

It is, accordingly, the principal object of this invention to provide a novel and improved camera bag of the character described that includes a waist strap or belt that can readily be released for attachment of the camera bag securely about the waist of the user.

A more particular object of the invention is to provide a waist supportable camera bag of the character described wherein the waist strap or belt is normally hidden or stowed against the inside of the camera bag with use of a zippered cover flap.

Other objects, features and advantages of the invention will be apparent from the following description when read with reference to the accompanying drawings. In the drawings, wherein like reference numerals denote corresponding parts throughout the several views;

Figure 1:
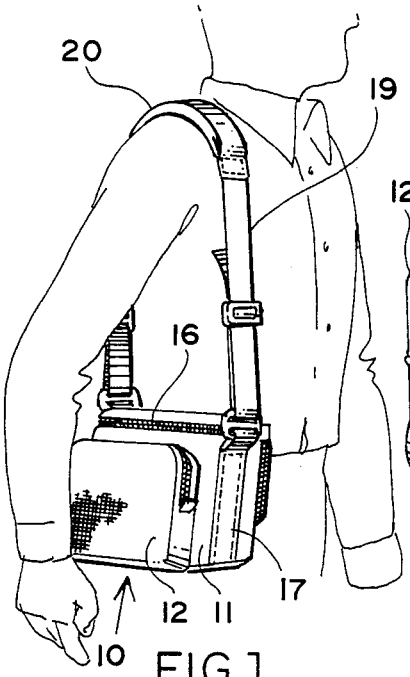
FIG. 1 illustrates one way in which the belt supported camera bag can be worn while in use.
Figure 2:
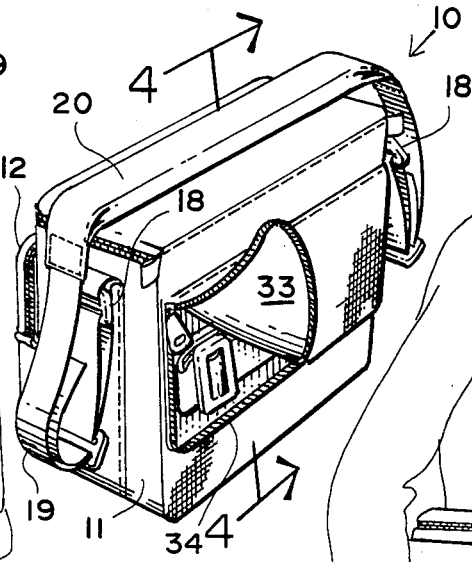
FIG. 2 is an oblique view, as viewed from above, of a belt-supported camera bag embodying the invention, showing the side compartment flap partially open to reveal stowage of the waist strap.
Figure 3:
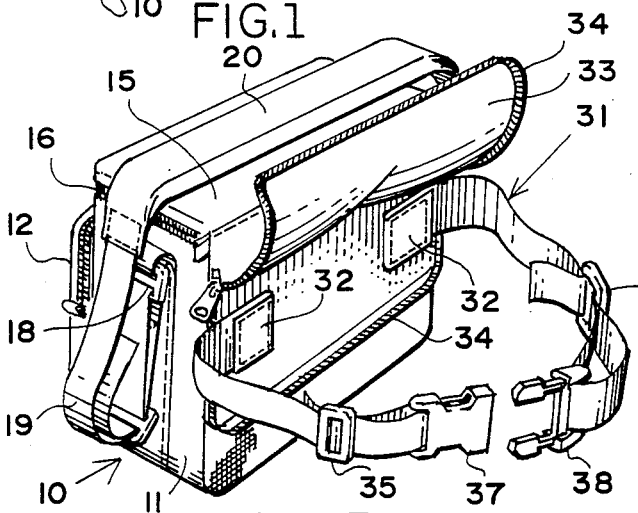
FIG. 3 is an oblique view similar to that of FIG. 2, but showing the side compartment flap fully open and the waist strap released for use.

Referring now in detail to the drawings, reference numeral 10 in FIGS. 1, 2 and 3 designates, generally, a belt-supported camera bag embodying the invention, the same comprising a main camera bag compartment 11 and an auxiliary compartment 12 of a somewhat smaller size sewn against one side of said main compartment, so that they share a common interior divider wall 13. (See FIG. 4).

The main camera bag compartment 11 and the auxiliary compartment 12 are substantially rectangular in shape, and are fabricated of a flexible, wear-resistant fabric such as a heavy duty, moisture-resistant, woven fabric that can readily be sewn for convenience in manufacturing. A side fastener or zipper 14 extending centrally along the top and partially down on each side of the auxiliary compartment 12 permits opening and closing of said compartment for the insertion and removal of camera supplies, such as photographic film. A rectangular top flap 15 sewn along the inside at the top of the main compartment 11 can be removeably secured in closing relation with respect thereto by a slide fastener or zipper 16. Fabric straps 17, sewn centrally along the ends of the main compartment 11 of the belt-supported camera bag terminate in rectangular eye links 18 through which are threaded the ends of an adjustable carrying strap 19. The carrying strap 19 has sewn or otherwise affixed centrally therealong a shoulder strap padding member 20.

Figure 4:
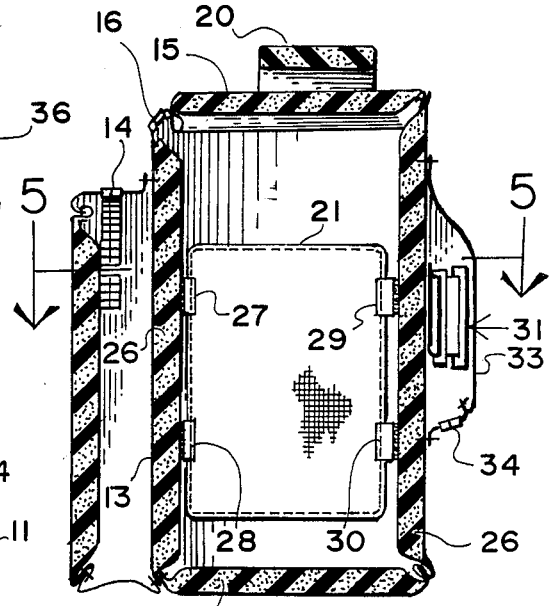
FIG. 4 is a vertical, cross-sectional view, taken along a plane indicated at 4—4 of FIG. 2 in the direction of the arrows.
Figure 5:
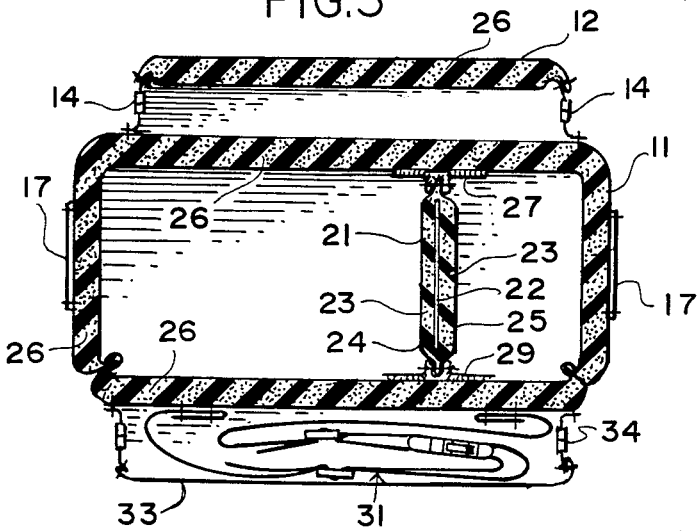
FIG. 5 is a transverse, cross-sectional view taken along the plane indicated at 5—5 of FIG. 4 in the direction of the arrows.

Removeably receivable within the main compartment 11 is a rectangular insert partition 21 having cushioning properties. As best illustrated in FIG. 5, the insert partition 21 is fabricated of a semi-rigid central panel 22, of cardboard or the like, faced with layers of foam cushion material 23, all sandwiched together between soft fabric covering panels 24, 25. The peripheral walls, top and bottom, of the main compartment 11, as well as the outer wall of the auxiliary compartment 12, are layered with foam material, indicated at 26 in FIGS. 4 and 5, and covered on the inside with a soft, fine, wool-like fabric to which the miniature hooks or burrs of pressure-sensitive VELCRO strips will adhere. As further illustrated in FIG. 5, longitudinal edges of the insert partition 21 have sewn thereto, in spaced relation along each side, VELCRO hook or burr strips 27, 28, 29, 30 which are used to releasably secure said insert partition at any desired position between the inner sidewall fabric surface of the main compartment 11. It is apparent that the insert partition 21 can be positioned to provide sub-compartments of adjustable size to accommodate any particular size of camera or camera accessories suitable for carrying in the camera bag.

An important feature of my invention resides in the provision of a waist strap or belt, normally hidden from view, which, whenever needed, can be quickly released for securing the camera bag firmly against the side of the user's body. To this end, the main camera bag compartment 11, at the opposite side thereof from that of the auxiliary compartment 12, has sewn thereagainst, interior end portions of a two-part waist strap or belt 31. As illustrated in FIG. 3, the inner ends of the belt portions are doubled-over and sewn in place, as indicated at 32, in horizontally spaced disposition. A fabric panel 33 sewn along its upper edge against the same side of the main camera bag compartment 11, folds over the waist strap or belt 31 when said belt is compactly stowed, as illustrated in FIGS. 2, 4 and 5. A zipper 34 sewn along the free edge of the cover flap 33 and the pertaining outside of the main compartment 11 provides for compact closure and hiding of the waist strap or belt 31 when not in use.

As best illustrated in FIG. 3, the outwardly-extending end portions of the waist strap or belt 31 are provided with slide loops 35, 36 for adjustably securing compemental attachment buckle members 37, 38, of known construction. The waist strap or belt assembly thus provides for ready adjustment to the waist size of the user with easy attachment and release.

Figure 6:
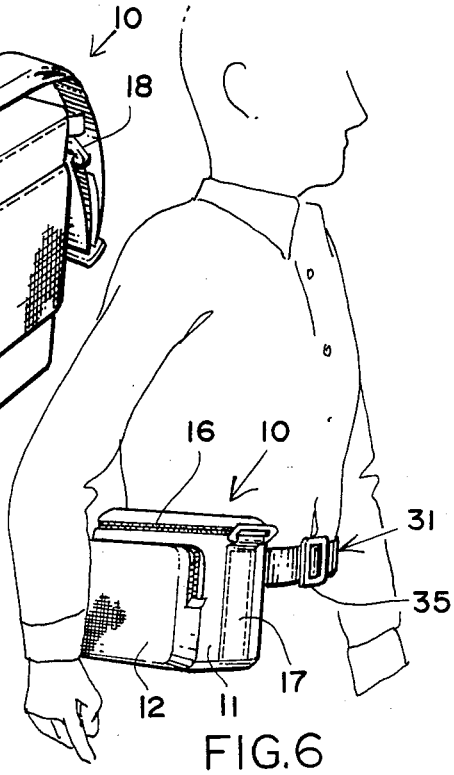
FIG. 6 is a view similar to that of FIG. 1, but illustrating how the waist band alone can be used for supporting the camera bag in place against the body.

In use, the camera bag can be supported in ordinary fashion by the shoulder carrying strap, as illustrated in FIG. 1. If the waist strap or belt 31 is to be used, as illustrated in FIG. 6, the shoulder carrying strap 19 can readily be removed. Under certain conditions, when heavy camera equipment is being carried, for example, both the shoulder strap and the waist strap or belt could be used. Such usage would also be particularly advantageous when involved in photographing events where strenuous activity may be involved, such as sports events or important news events.

While I have illustrated and described herein only one form in which my invention can conveniently be embodied in practice, it is to be understood that this embodiment is presented by way of example only and not in a limiting sense. The invention, in brief, comprises all the embodiments and modifications coming within the scope and spirit of the following claims.

What I claim as new and desire to secure by Letters Patent is:

1. A belt supported camera bag comprising, in combination, a substantially rectangular main camera bag compartment of flexible material, an auxiliary camera bag compartment of flexible material secured against one side of said main camera bag compartment, a flexible shoulder carrying strap the ends of which are secured with respect to one end each of said main camera bag compartment, a flexible waist carrying strap end portions of which are secured in mutually transverse spaced relation to the other side of said main camera bag compartment, means for enclosing and hiding said waist carrying strap against said other side of said main camera bag compartment when not being used as a belt for securement about the waist of the user, said waist strap enclosing and hiding means comprising a substantially rectangular flexible fabric panel sewn along one edge against said other side of said main camera bag compartment so as to be foldable over said flexible waist carrying strap when said waist carrying strap is folded in abutment against the outside of said other side of said main camera bag compartment, and a slide fastener sewn along the free edge of said cover flap and said outside of said other side of said main camera bag compartment.

2. A belt supported camera bag as defined in claim 1, including an interior partition wall member for subdividing said main camera bag compartment into two smaller interior compartments, said partition wall member being fabricated of a soft, pliable and flexible material serving as padding for contained articles.

3. A belt supported camera bag as defined in claim 2, wherein the interior of said main camera bag compartment is covered with a soft, wool-like fabric, said partition wall member including means for its releasable attachment to opposed inside zones of said main camera bag compartment to provide for changing the relative sizes of said smaller interior compartments.

4. A belt supported camera bag as defined in claim 3, wherein said releasable attachment means in pressure sensitive.

* * * * *